United States Patent [19]

Parisi

[11] 4,099,278

[45] Jul. 11, 1978

[54] SEAT CONSTRUCTION

[76] Inventor: Joseph J. Parisi, c/o Parisi, Inc., 10521 Drummond Rd., Philadelphia, Pa. 19154

[21] Appl. No.: 802,718

[22] Filed: Jun. 2, 1977

[51] Int. Cl.[2] ..... A47C 27/00

[52] U.S. Cl. ..... 5/361 B; 5/345 R; 5/DIG. 2; 297/DIG. 1

[58] Field of Search ..... 5/337, 338, 345 R, 361 B, 5/DIG. 2; 297/452, 455, 456, DIG. 1

[56] References Cited

U.S. PATENT DOCUMENTS

| | | | |
|---|---|---|---|
| 1,843,893 | 2/1932 | Becher | 5/361 B |
| 2,234,506 | 3/1941 | Sistig | 5/338 |
| 2,836,228 | 5/1958 | Dahle | 297/DIG. 1 |
| 2,898,975 | 8/1959 | Wagner | 5/337 X |
| 3,331,089 | 7/1967 | Ornas et al. | 297/452 UX |
| 3,844,613 | 10/1974 | Waldorf | 297/452 |
| 3,885,258 | 5/1975 | Regan | 5/361 B X |
| 3,955,224 | 5/1976 | Kramer | 5/347 |
| 3,987,507 | 10/1976 | Hall | 5/338 |

FOREIGN PATENT DOCUMENTS

| | | | |
|---|---|---|---|
| 1,123,904 | 6/1956 | France | 5/361 B |

*Primary Examiner*—James C. Mitchell

*Attorney, Agent, or Firm*—Smith, Harding, Earley & Follmer

[57] ABSTRACT

A seat construction is comprised of a relatively rigid support, a first cushion supported at its bottom surface on the support and having a recessed portion formed in its bottom, a second cushion supported at its bottom surface on the support and contained within the recessed portion of the first cushion, the first cushion being made of a resilient material of a relatively high density and compression characteristic and the second cushion being made of a resilient material that is softer and has a lower compression characteristic than the first cushion and a cover enclosing the outer surface of the first cushion and secured to the support.

14 Claims, 6 Drawing Figures

SEAT CONSTRUCTION

BACKGROUND AND SUMMARY OF THE INVENTION

This invention relates generally to seat constructions and more particularly to a seat construction of the type comprising a cushion supported on a relatively rigid support and enclosed by a cover which is secured to the support.

In the seat construction of the indicated type, the cushions typically are made of foam material. In the prior art seat constructions, the foam cushion becomes compressed to take a set as much as ten to fifteen percent after the seat construction has been in use for a period of time. This permanent compression or set of the cushion permits wrinkles to be formed on the cover presenting an unsightly appearance. While a cushion of a very high density or compression characteristic might not take a set, such a cushion would be too hard to provide the seating comfort that most people require.

The softness and compression characteristics of a foam cushion are described in the art in terms of density and/or indentation load deflection (ILD). The lower the density or ILD, the softer the cushion and vice versa.

The seat construction of the invention is designed to overcome the above-described problem of wrinkle production in the cover. In accordance with the invention, the seat construction is formed with a softer region extending along the natural seating line of the seat construction. This is achieved by the provision of a pair of cushions, a first cushion being supported at its bottom surface on a relatively rigid support and having a recessed portion formed in its bottom, and a second cushion being supported at its bottom on the rigid support and contained within the recessed portion of the first cushion. The first cushion is made of a resilient material and the second cushion is made of a resilient material that is softer than the first cushion. A cover e ncloses the outer surface of the first cushion and is secured to the rigid support to complete the seat.

By reason of the above-described seat construction, there is provided a comfortable seat since the user actually "sits into" the seat. Moreover, the design serves to eliminate wrinkles because the hard material forming the outer cushion will not take any significant set. At the same time, along the natural seating line, there is provided a comfortable seating region by reason of the softer insert cushion. The harder outer cushion provides a good support to the user by bolding the legs up to give a comfortable seating feeling whereby the user sits into the seat. In addition, the seat compresses more easily in the region of the natural seating line where the softer insert cushion is provided. Thus, the outer cushion serves to hold the cover in place to prevent the formation of wrinkles while the insert cushion provides a soft seating region extending along the natural seating line of the seat construction. This gives the feeling of softness throughout the entire seat construction.

DETAILED DESCRIPTION OF THE PREFERRED EMBODIMENT OF THE INVENTION

Figure 1:
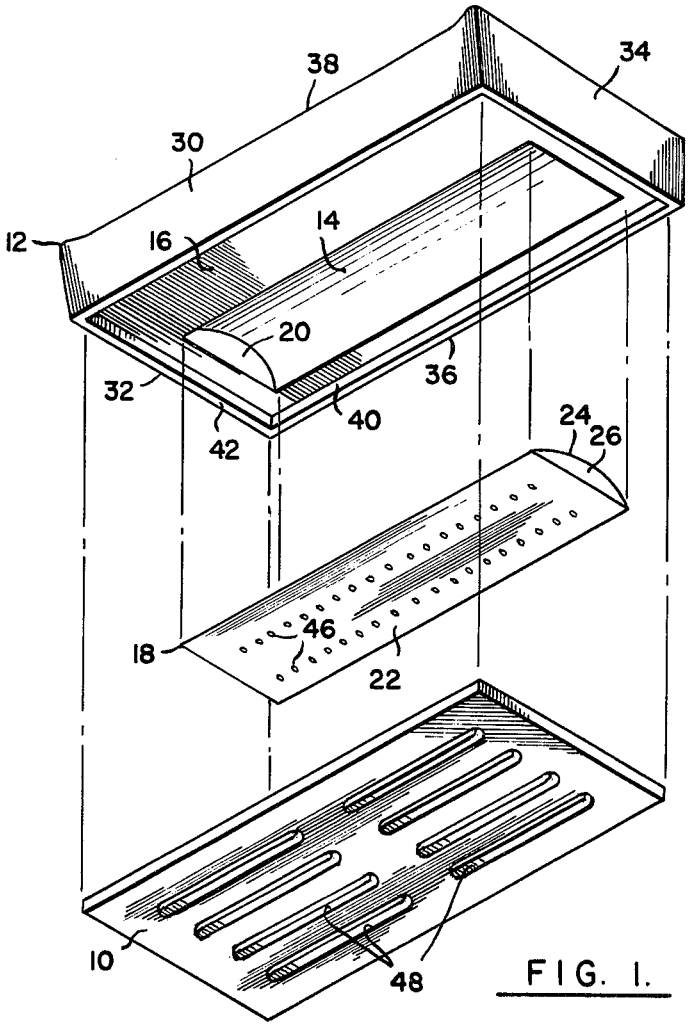
FIG. 1 is an exploded view of three elements of the seat construction of the invention.
Figure 2:
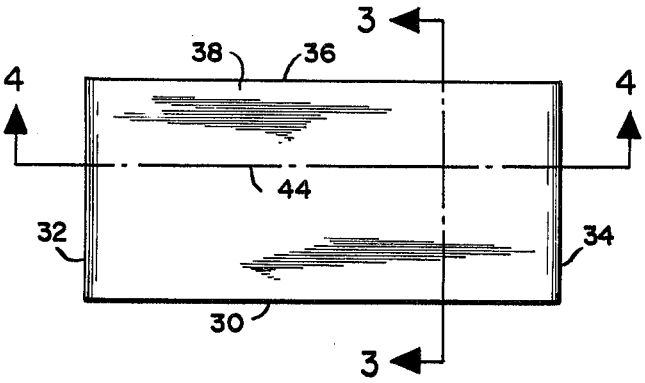
FIG. 2 is a top view of a seat construction in accordance with the invention.

Referring to FIGS. 1 to 4 of the drawings, the seat construction of the invention comprises a rectangular support 10 made of a relatively rigid material such as plywood, a first cushion 12 having a recessed portion 14 formed in its bottom 16, and a second cushion 18. The cushions 12 and 18 are made of a foam material as will be described more fully hereafter.

Figure 4:
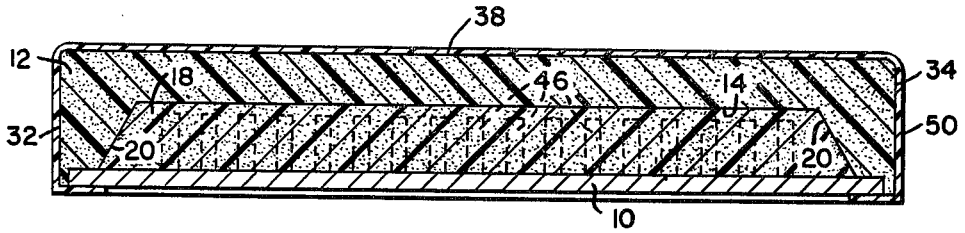
FIG. 4 is a section taken on line 4—4 of FIG. 2.

The recessed portion 14 is elongated along the width of the seat construction and has an arcuate shape with sloped ends 20 as shown in FIG. 4. The cushion 18 is shaped to conform to the shape of the recessed portion 14 so as to provide an insert or a core which fills the recessed portion 14. To this end, the cushion 18 has a flat bottom 22, an arcuate top wall 24 and a pair of sloped ends 26. In the assembled condition of the seat construction, the cushion 18 is positioned within the recessed portion 14 so that the bottom 16 of the cushion 12 and the bottom 22 of the cushion 18 are aligned in the same horizontal plane and are supported on the support 10.

The cushion 12 has a generally rectangular construction to conform to the shape of the support 10 and has a vertical front wall 30, a pair of vertical side walls 32 and 34, a vertical rear wall 36, and a horizontal top 38. Spaced inwardly from the front, side and rear walls of cushion 12 there is formed a rectangular shaped bottom recess 40 adapted to receive the support 10. The bottom recess 40 cooperates with the front, side and rear walls of the cushion 12 to define a rectangular skirt 42 extending peripherally around the edges of support 10 in the assembled condition of the seat construction.

The recessed portion 14 is located to be centered on and extend along the "natural seating line" of the seat construction. "Natural seating line" is a term of art describing the vertical plane whereat the weight of the user of the seat is concentrated. A typical seat having a depth of twenty inches would have its natural seating line about twelve inches back from the front edge of the seat. In the seat construction shown in FIGS. 1 to 4, the natural seating line is indicated by the line 44.

Figure 3:
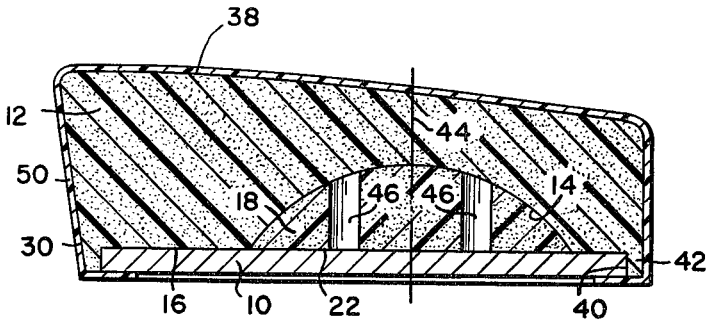
FIG. 3 is a section taken on line 3—3 of FIG. 2.

The cushion 18 is provided with a plurality of holes 46 which are spaced apart and extend vertically through the cushion 18 from the bottom 22 to the top 24. The holes 46 are arranged in two parallel rows extending along the width of the seat construction and equally spaced from the natural seating line 44 on opposite sides thereof as is best shown in FIG. 3. It is well known in the art to provide holes in seat cushions such as the holes 46 to permit the escape of air from the cushions when they are depressed by someone sitting on the seat construction.

The support 10 is provided with a plurality of slots 48 spaced apart throughout the extent of the support 10 as is shown in FIG. 1. The slots 48 permit the escape of air from the cushions when they are depressed and are conventional in the art. The air escape passages may also be provided by a plurality of holes distributed evenly throughout the extent of the support 10.

In the assembled seat construction, a cover 50 is extended over the outside surface of the cushion 12 to completely enclose the same. The cover 50 is secured, as by staples, to the bottom side of the support 10 as is best shown in FIG. 3. The cover 50 may be made of various suitable materials, such as vinyl.

Cushions 12 and 18 are made of foam, such as molded urethane, with insert cushion 18 being softer and having a lower compression characteristic than the outer cushion 12. In the art, the softness and compression characteristic of cushions of this type are described in terms of pounds of ILD, i.e. indentation load deflection. Indentation load deflection is the resistance, in pounds, of a material (such as foam) after deflection over a fifty square inch area to 25% of its original height, the measurement being performed in accordance with ASTM test D-2406. In a typical seat construction in accordance with the invention, the cushion 12 is made from a material having an ILD of forty-nine pounds and the cushion 18 is made from a material having an ILD of less than about forty pounds.

The insert cushion 18 is removably positioned within recessed portion 14 of cushion 12 so that various cushions 18 may be inserted within the recessed portion 14 of a cushion 12 to change the softness and compression characteristics of the seat construction. The lower the ILD rating of the insert cushion 18 used, the softer will be the seat provided. Accordingly, a manufacturer can maintain a supply of insert cushions 18 of different ILD ratings to meet customer requirements for seats having various characteristics of softness.

In the seat construction of the invention, the hard cushion 12 is provided around the outside of the seat to cause the cover 50 to return to its original shape after the seat is used, thereby preventing the formation of wrinkles. This hard cushion 12 also serves to support the legs of a user very promptly as he sits down on the seat. At the same time, the seat construction provides soft support for the user along the "natural seating line" of the seat by reason of the provision of the insert or core cushion 18 which has a lower ILD than cushion 12 and hence is softer and more easily compressible.

Figure 5:
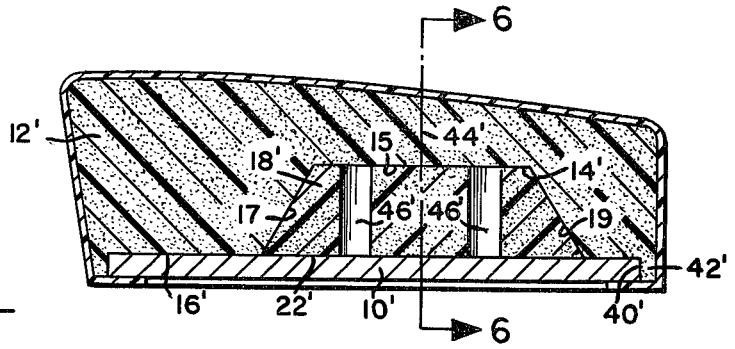
FIG. 5 is a sectional view showing a second embodiment of the seat construction of the invention.
Figure 6:
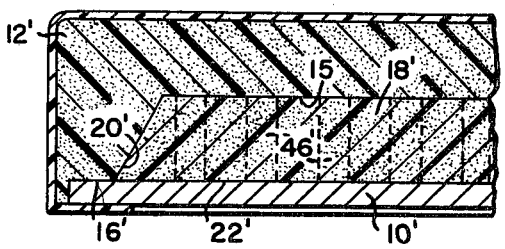
FIG. 6 is a section taken on line 6—6 of FIG. 5.

In FIGS. 5 and 6, there is provided an alternate form of insert cushion for use in the seat construction of the invention. Since the cushion construction shown in FIGS. 5 and 6 is essentially the same as that shown in FIGS. 1 to 4 (the only difference being the shape of the insert cushion) corresponding parts have been given like reference numerals with primes added.

There is provided a rectangular support 10', a first cushion 12' having a recessed portion 14' formed in its bottom 16', and a second cushion 18' adapted to fit within the recessed portion 14'. The cushions 12' and 18' are made of a foam material of the same type as in the seat construction shown in FIGS. 1 to 4.

The recessed portion 14' is elongated along the width of the seat construction and has a flat bottom 15, a pair of longitudinally extending sloped front and rear sides 17 and 19, respectively, and sloped ends 20'. The cushion 18' is shaped to conform to the shape of the recessed portion 14' so as to provide an insert or core which fills the recessed portion 14'. Accordingly, the insert cushion 18' is provided with a flat top and sloped sides and ends which are placed side-by-side with the corresponding walls of the recessed portion 14'.

In the assembled condition of the seat construction shown in FIGS. 5 and 6, the cushion 18' is positioned within the recessed portion 14' so that the bottom 16' of the cushion 12' and the bottom 22' of the cushion 18' are aligned on the same horizontal plane for support on a support 10'. The cushion 12' has a generally rectangular construction and is provided with a rectangular shaped recess 40' adapted to receive the support 10'. The bottom recess 40' defines a rectangular skirt 42' which is adapted to extend peripherally around the edges of the support 10' for the cushions 12' and 18'. A cover 50' is extended over the outside surface of the cushion 12' to enclose the same, the cover 50' being secured to the support 10' by staples.

The recessed portion 14' is located to be centered on and extend along the natural seating line 44' of the seat construction. The cushion 18' is provided with a plurality of holes 46' which are spaced apart and extend vertically through the cushion 18', the holes 46' being arranged in two parallel rows extending along the width of the seat construction and equally spaced from the natural seating line 44' on opposite sides thereof. The support 10' is provided with a plurality of slots similar to the slots 48 in support 10 to provide escape passages for air from the cushions.

In the preferred form of the invention, the insert cushion is not glued onto the mating surfaces of the recessed portion of the outer cushion. This makes the insert cushion removable and permits the substitution of other insert cushions having various softness and compression characteristics. Since the insert cushion is not glued in place, the insert cushion should be shaped so that it will not stick in a compressed condition to a mating surface of the recessed portion in the outer cushion. To this end, the cushion 18 is provided with an arcuate shape as is best shown in FIG. 3, the cushion 18' is provided with sloped longitudinal sides 17 and 19 as shown in FIG. 5, and each of the cushions 18 and 18' is provided with sloped ends 20 and 20', respectively. By reason of this design, cushions 18 and 18' taper or slope inwardly from their bottoms 20 and 22', respectively. It will be apparent that if the cushions 18 or 18' were shaped to have any vertical walls, such vertical walls could coact with a mating wall on the recessed portion of an associated outer cushion to stick in a compressed condition. The occurrence of this condition would prevent the seat construction from performing in accordance with its design as described more fully above.

While there has been described herein certain preferred embodiments of the invention, it is to be understood that the invention is not limited thereto and may be otherwise variously practiced within the scope of the following claims. For example, invention is applicable to curved seat constructions in addition to the straight rectangular seat construction shown and described herein.

I claim:

1. A seat construction comprising:

a relatively rigid support, a first cushion supported at its bottom surface on said support and having a recessed portion formed in its bottom, a second cushion supported at its bottom surface on said support and contained within said recessed portion of said first cushion, said second cushion and said recessed portion being confined to a limited region of said first cushion with a depth substantially less than the depth of said first cushion, said first cushion made of a resilient material, said second cushion being made of a resilient material softer than said first cushion, and a cover enclosing the outer surface of said first cushion and secured to said support.

2. A seat construction according to claim 1 wherein said first and second cushions are made of a foam material.

3. A seat construction according to claim 2 wherein said recessed portion is elongated along the width of the seat construction and said second cushion is shaped to conform to the shape of said recessed portion to provide a core filling the same.

4. A seat construction according to claim 3 wherein said second cushion and said recessed portion have sloped end walls in side-by-side relation.

5. A seat construction according to claim 3 wherein said second cushion and said recessed portion have mating surfaces having an arcuate shape.

6. A seat construction according to claim 5 wherein said second cushion and said recessed portion have mating sloped end walls.

7. A seat construction according to claim 3 wherein said recessed portion has a flat bottom and a pair of sloped side walls extending from said flat bottom to the bottom surface of said first cushion and said second cushion has surfaces mating with said flat bottom and sloped side walls.

8. A seat construction according to claim 7 wherein said second cushion and said recessed portion have mating sloped end walls.

9. A seat construction according to claim 3 wherein said recessed portion is approximately centered on and extends along the natural seating line of the seat construction.

10. A seat construction according to claim 2 wherein said second cushion forms an insert filling said recessed portion.

11. A seat construction according to claim 10 wherein said second cushion has a plurality of holes spaced apart from each other and extending through said second cushion from the bottom thereof.

12. A seat construction according to claim 11 wherein said spaced apart holes are arranged in a pair of rows extending along the width of the seat construction.

13. A seat construction according to claim 2 wherein the indentation load deflection of said second cushion is less than that of said first cushion.

14. A seat construction according to claim 1 wherein said second cushion is removably positioned within said recessed portion of said first cushion to permit the substitution of another cushion.

* * * * *